US011976435B2

(12) United States Patent
Fälschle

(10) Patent No.: US 11,976,435 B2
(45) Date of Patent: May 7, 2024

(54) QUICK-CHANGE DEVICE

(71) Applicant: OilQuick Deutschland KG, Steindorf (DE)

(72) Inventor: Florian Fälschle, Merching (DE)

(73) Assignee: OilQuick Deutschland KG, Steindorf (DE)

( * ) Notice: Subject to any disclaimer, the term of this patent is extended or adjusted under 35 U.S.C. 154(b) by 851 days.

(21) Appl. No.: 17/010,908

(22) Filed: Sep. 3, 2020

(65) Prior Publication Data

US 2020/0399853 A1 Dec. 24, 2020

Related U.S. Application Data

(63) Continuation of application No. PCT/EP2019/055374, filed on Mar. 5, 2019.

(30) Foreign Application Priority Data

Mar. 6, 2018 (DE) ..... 10 2018 105 049.6
Nov. 23, 2018 (EP) ..... 18207938

(51) Int. Cl.
*E02F 3/34* (2006.01)
*E02F 3/36* (2006.01)

(52) U.S. Cl.
CPC ..... *E02F 3/3622* (2013.01)

(58) Field of Classification Search
CPC ..... E02F 3/3613; E02F 3/3622
See application file for complete search history.

(56) References Cited

U.S. PATENT DOCUMENTS 6,154,989 A 12/2000 Kaczmarski et al.
6,301,811 B1 10/2001 Gilmore, Jr.
6,422,805 B1 7/2002 Miller
6,481,124 B1 11/2002 Miller
8,857,081 B2 * 10/2014 McCormick ..... E02F 3/365 37/468
9,783,951 B2 10/2017 Nilsson et al.
(Continued)

FOREIGN PATENT DOCUMENTS

CH 700307 A1 7/2010
DE 2249268 A 4/1974
(Continued)

OTHER PUBLICATIONS

International Preliminary Report on Patentability dated Sep. 8, 2020, with Written Opinion for PCT/EP2019/055374 (English translation) (8 pages).
(Continued)

*Primary Examiner* — Joshua T Kennedy
(74) *Attorney, Agent, or Firm* — Paul Bianco; Jose Gutman; Fleit Intellectual Property Law

(57) ABSTRACT

A quick-change device for changing attachments on a construction machine includes a support, first receptacles arranged on one side of the support for receiving a first coupling element, second receptacles arranged on the other side of the support for receiving a second coupling element, and a capturing device arranged on the support for capturing the attachment. In order to avoid damage to the support caused by improper strain on the capturing device, the capturing device has at least one capturing hook pivotably arranged on the support.

14 Claims, 7 Drawing Sheets

(56) References Cited

U.S. PATENT DOCUMENTS

| | | | | |
|---|---|---|---|---|
| 9,903,091 | B2 | 2/2018 | Tsukada | |
| 2007/0157492 | A1 | 7/2007 | Miller et al. | |
| 2010/0107456 | A1* | 5/2010 | Miller | E02F 3/3618 37/468 |
| 2010/0232920 | A1* | 9/2010 | Calvert | E02F 3/3663 414/723 |
| 2012/0177472 | A1 | 7/2012 | Hill | |
| 2012/0266432 | A1* | 10/2012 | Balemi | E02F 3/369 403/376 |
| 2017/0067223 | A1 | 3/2017 | Tsukada et al. | |
| 2018/0066418 | A1* | 3/2018 | Keighley | E02F 3/3663 |
| 2020/0149243 | A1* | 5/2020 | Schmid | E02F 3/365 |
| 2021/0131057 | A1* | 5/2021 | Miller | E02F 3/3618 |
| 2021/0222392 | A1* | 7/2021 | Miller | E02F 3/3663 |

FOREIGN PATENT DOCUMENTS

| | | | | |
|---|---|---|---|---|
| DE | 3538156 | C1 | 7/1986 | |
| DE | 20 2013 004797 | U1 | 8/2014 | |
| DE | 10 2015 225498 | A1 | 6/2017 | |
| EP | 2119834 | A2 | 11/2009 | |
| EP | 2159334 | A1 | 3/2010 | |
| GB | 2612533 | A * | 5/2023 | E02F 3/3609 |
| IE | 981051 | A1 | 6/1999 | |
| JP | H10-140596 | A | 5/1998 | |
| JP | 2000-008402 | A | 1/2000 | |
| JP | 2002-524673 | A | 8/2002 | |
| WO | 2000/14342 | | 3/2000 | |
| WO | 2013/048308 | A1 | 4/2013 | |
| WO | 2015/199081 | A1 | 12/2015 | |
| WO | 2018/089810 | A8 | 5/2018 | |

OTHER PUBLICATIONS

For Japanese Patent Application No. 2020-524337 (related to U.S. Appl. No. 17/010,908): Office Action dated Aug. 2021 with English summary (8 pages) Office Action dated Mar. 2022 with English summary(9 pages).

European Search Report dated May 21, 2019, for European Application No. 18 20 7938.

Canadian Search Report dated Nov. 17, 2021, for Canadian Application No. 3,081,804.

For Japanese Patent Application No. 2020-524337: English summary of Office Action dated Aug. 31, 2021 English summary of Office Action dated Apr. 1, 2022.

Result of Examination for German Patent Applicatoin 10 2018 105 049.6, filed Mar. 6, 2018.

International Search Report for PCT/EP2019/055374, dated Jun. 5, 2019.

Written Opinion for PCT/EP2019/055374, filed Mar. 5, 2019.

* cited by examiner

QUICK-CHANGE DEVICE

FIELD OF THE INVENTION

The present invention relates to a quick-change device.

BACKGROUND

Quick-change devices of this type are used to easily and conveniently change different attachments on construction machines. Using this type of quick-change device allows, e.g., swivel buckets, claws, shears, compactors, magnets, hydraulic hammers or other attachments to be coupled to and uncoupled from, e.g., a boom of an excavator, within a few seconds and at a high safety standard from an operator's cab.

U.S. Pat. No. 6,154,989 A discloses a generic quick-change device. This quick-change device comprises a support which, arranged on one side, has first receptacles for holding a first coupling element disposed on an attachment and, arranged on the other side, second receptacles with a locking element for releasably holding a second coupling element, which locking element can be moved between a released position and a locked position. To prevent the attachments from falling down, which could potentially put individuals at risk if the locking element were to be unintentionally moved into a released position, a capturing device with a hook arrangement for holding a transverse bar, which interacts with complementary hooks on the attachment, is arranged on the support. Since the hook arrangement provided for safety purposes is integrally formed in one piece with the support, the support as a whole will necessarily always be affected as well whenever the hook arrangement is damaged as a result of improper use. A repair and/or a changeover therefore entail(s) considerable cost and time expenditure.

SUMMARY

One aspect of the present invention relates to a quick-change device of the type mentioned above, which makes it possible to avoid damage to the support caused by improper strain on the capturing device.

Convenient embodiments and advantageous further advanced modifications of the invention are also disclosed.

The capturing device on the quick-change device according to the present invention comprises at least one capturing hook pivotably connected to the support. Because of the pivotable arrangement, the capturing hook can yield if, e.g., an operator, while handling the quick-change device, causes the capturing hook to bump into an obstacle or if a capturing hook is improperly used to support an excavator on the ground in order to turn it around or relocate it. Thus, because of the yieldability of the capture hooks, shocks or forces acting on the capturing hook are not directly transmitted to the support, which causes less strain to be exerted on the connection to the support, thereby affecting the support to the lowest possible extent. Furthermore, a capturing hook that has been damaged due to improper use can be easily replaced without replacing the entire support. The entire support need not be dismantled or replaced. The at least one capturing hook is designed to capture an attachment coupled to the quick-change device even if a locking device is unintentionally released and to thereby prevent an undesirable release of the attachment from the quick-change device. The capturing hook is completely independent of the operator-controlled locking device of the quick-change device and thus offers increased safety even if improperly operated. Thus, for the purpose of additional safety, the capturing hook is designed to capture an attachment independently of the operator.

The capturing device can comprise one or a plurality of capturing hooks which may be separated from or connected to each other. According to one especially advantageous embodiment, the capturing device has two capturing hooks pivotably arranged on the first receptacles of the support. The capturing hooks can be designed as separate and separately pivotable capturing hooks. However, they can also be connected to each other.

According to a robust and structurally advantageous embodiment, the capturing hook can be disposed on a bridge-like joining member of the support so as to pivot about a transverse shaft. To pivotably mount the capturing hook, the bridge-like joining member can have a cross bore, and the capturing hook can have suitable receiving bores for receiving the transverse shaft.

The capturing hook can advantageously be pivotably mounted on the transverse shaft by means of bearing sleeves. In this manner, the capturing hook can be hinged to the support, thereby ensuring low friction and reliable protection against wear. The transverse shaft can be secured relative to the support by means of a pin to prevent it from falling out and twisting.

According to one possible embodiment, the bridge-like joining member can protrude into an intermediate space between two rearwardly protruding legs of the capturing hook. On the ends of the legs facing the direction of the support, the capturing hook can have an upper curvature and a rear abutment surface for abutting a front stop surface of the support.

According to a second possible embodiment, the bridge-like joining member can protrude into a recess on the rearward face of the capturing hook, which recess has an upper inner surface and a lower inner surface. Preferably disposed between the bridge-like joining member and the upper and lower inner surface of the recess is an upper and a lower gap in which a damping element is disposed.

However, the capturing hook may also be inserted into half-shell receptacles on the support by means of bearing journals in the form of transverse shafts integrally formed in one piece with the capturing hooks and may be held in place from below by means of a complementary part. The half-shell receptacles for rotatably mounting the transverse shafts can be disposed on the top face of two parallel legs arranged at a distance from one another on the bridge-like joining members of the support.

According to a structurally simple embodiment, the capturing hook is designed to clasp around a coupling element engaging in the first receptacles.

BRIEF DESCRIPTION OF THE DRAWINGS

Additional characteristic features and advantages of the invention will emerge from the following description of a preferred exemplary embodiment with reference to the drawings.

The Drawings Show.

DETAILED DESCRIPTION

Figure 1:
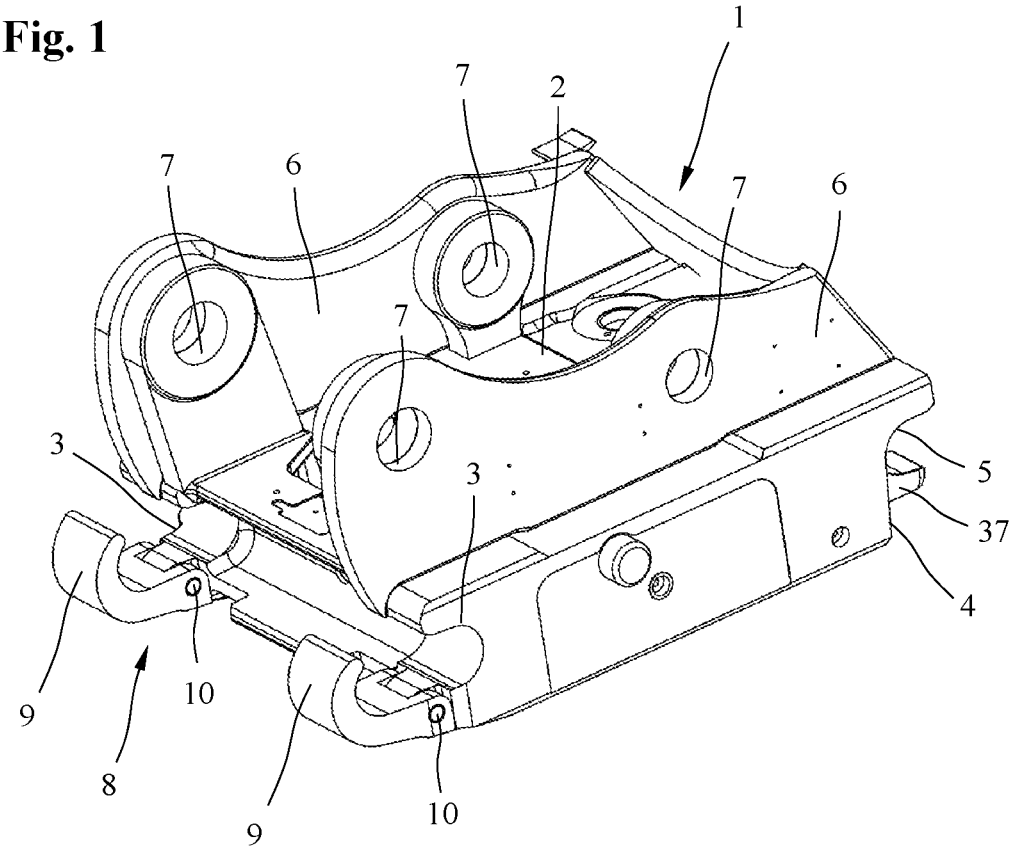
FIG. 1 a first embodiment of a quick-change device with a capturing hook arrangement in an unfolded starting position.

FIG. 1 shows a quick-change device 1 for easily and conveniently changing different attachments on construction machines, in particular excavators. Using this type of quick-change device allows, e.g., swivel buckets, claws, shears, magnets, compactors, hydraulic hammers or other mechanical and/or hydraulic attachments to be easily and conveniently coupled to and uncoupled from a boom or another attachment part of an excavator or a different construction vehicle from an operator's cab.

The quick-change device 1 shown comprises a support 2 in the form of a welded or cast part which, on one side, has forwardly open first receptables 3 for receiving and holding in place a first bolt-shaped coupling element and, on the other side, downwardly open second receptacles 4 for receiving a second bolt-shaped coupling element. The forwardly open first receptacles 3 are configured in the form of claws or forks. The downwardly open receptacles 4 have a curved lower abutment surface 5 for abutting the second bolt-shaped coupling element. The support 2 comprises a locking device which, in the embodiments described in greater detail below, consists of two bolt-shaped locking elements 37 which can be moved between a retracted released position and an extended locked position. The bolt-shaped locking elements 37 are movably guided in the axial direction in horizontal guiding bores inside the support 2 and can be hydraulically moved by means of a piston between the retracted released position and the extended locked position shown in FIG. 1. In the extended locked position, the downwardly open second receptacles 4 are closed on the bottom face by the locking elements 37 which are movably disposed in the support 2 so that the second bolt-shaped coupling element is engaged from below by the locking element 37.

In the embodiment shown, the support 2 comprises two claw-shaped first receptacles 3 for a first coupling element on one side and two receptacles 4 for a second coupling element on the other side. In addition, on two parallel lateral parts 6 disposed on the top face of the support 2, receiving openings 7 for mounting bolts (not shown in the drawings) for mounting the quick-change device 1 on a boom of an excavator or a connecting part of another construction vehicle.

To connect an attachment by means of the quick-change device 1, the quick-change device 1, which, as a rule, is disposed on a boom of an excavator, is first moved so that a first coupling element, which is disposed, e.g., on an adapter or on the attachment, is retracted into the claw-shaped receptacles 3 on one side of the quick-change device 1. Subsequently, the quick-change device 1, with the locking elements 37 still retracted, is pivoted about the first bolt-shaped coupling element in such a way that a second coupling element on the adapter or attachment comes to abut the abutment surfaces 5 of the downwardly open receptacles 4 on the other side of the quick-change device 1. Subsequently, the bolt-shaped locking elements 37, which are movably disposed in the guiding bores in the support 2 of the quick-change device 1, can be hydraulically extended so that the second bolt-shaped coupling element is engaged from below by the two bolt-shaped locking elements 37 on the quick-change device 2, and the attachment is thus held in place on the quick-change device 1.

To prevent an attachment coupled to the quick-change device 1 from becoming detached from the quick-change device, in the event of an unintentional release movement of the locking element caused by an operator error or by malfunctions, and from subsequently potentially falling down while the quick-change coupler device is in a lifted position, a capturing device 8 shown in FIG. 1 is additionally disposed on the support 2. The capturing device 8 is designed to clasp around the coupling element which is disposed on an adapter or attachment and which comes to be engaged in the first receptacles 3. The capturing device 8 is designed in such a way that in the event that an attachment is unintentionally released from the coupling position, the attachment, as a result of the coupling element being engaged in the capturing hook arrangement, is captured in a captured position and is thereby held in place on the quick-change device.

Figure 2:
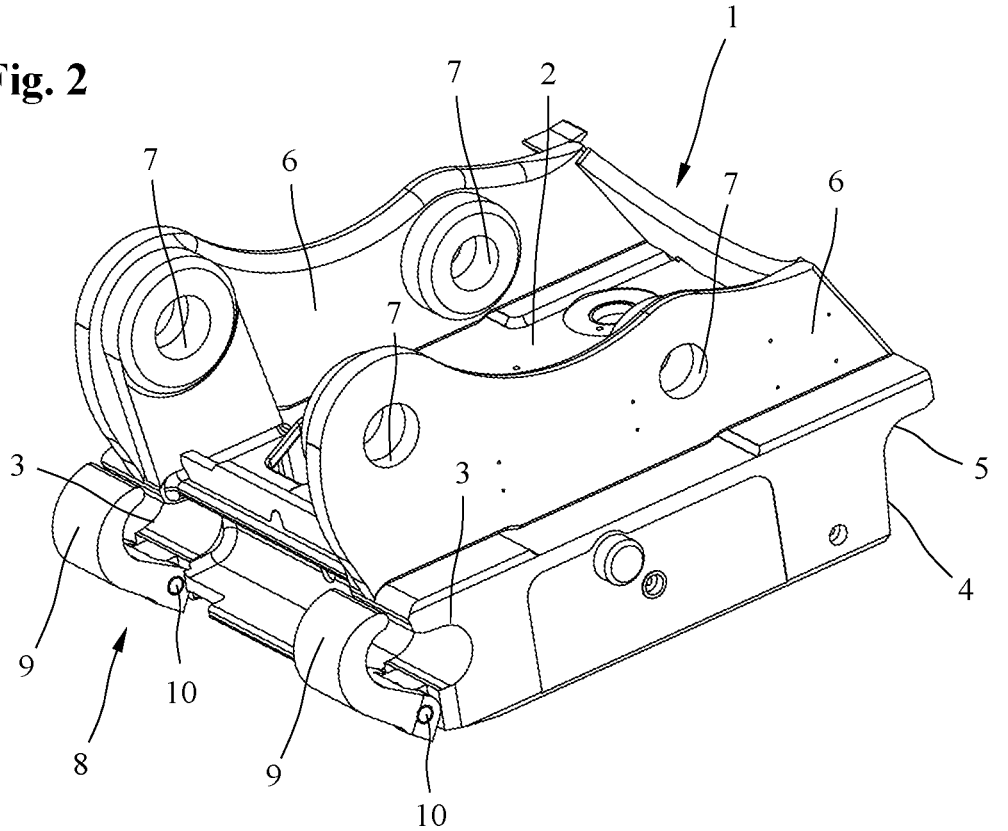
FIG. 2 the quick-change device shown in FIG. 1 with the capturing hook arrangement in an upper folded position.

In the embodiment shown, the capturing device 8 comprises two separate capturing hooks 9 which are non-rigidly disposed on the support 2 of the quick-change device 1 but rather connected to the support 2 by means of a type of hinge so as to be pivotable about a transverse shaft 10. The two capturing hooks 9 are designed to clasp around, e.g., a bolt-shaped coupling element on an attachment and, in the event that the quick-change device 1 is unintentionally released, to capture the attachment in a captured position by engaging the coupling element in the capturing hooks 9. Because of the pivotable arrangement, the capturing hooks 9 are able to move between a lower starting position as shown in FIG. 1 and an upper folded position as shown in FIG. 2.

Figure 3:
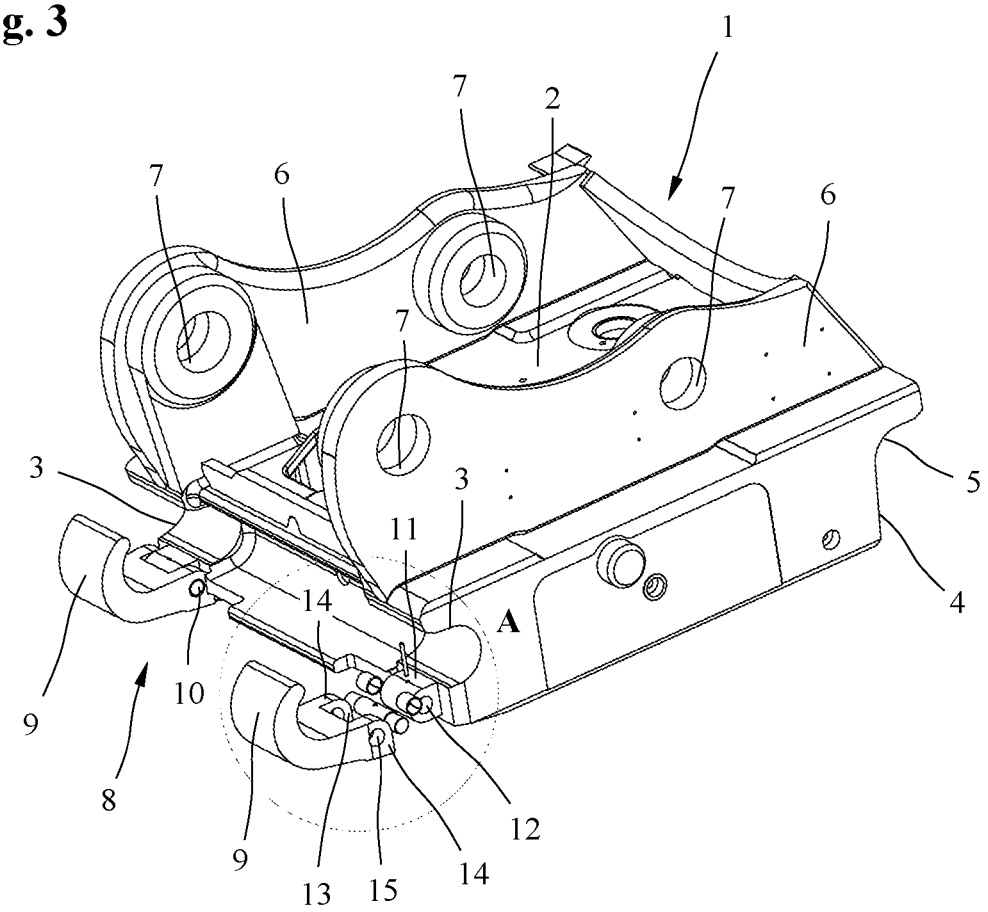
FIG. 3 the quick-change device shown in FIG. 1 with a capturing hook arrangement seen in an exploded view.
Figure 4:
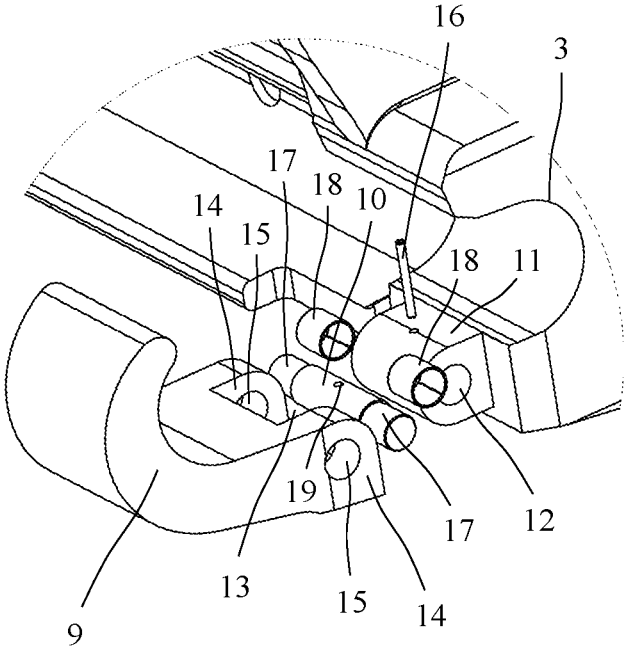
FIG. 4 an enlarged detail view A of FIG. 3.

As indicated in FIGS. 3 and 4, the support 2 has forwardly protruding bridge-like joining members 11 with a transverse bore 12 for connecting the capturing hooks 9. The forwardly protruding bridge-like joining members 11 disposed on the support 2 below the first receptacles 3 protrude into an intermediate space 13 between two rearwardly protruding legs 14 on the connecting part of the capturing hook 9, which connecting part is facing in the direction of the support 2. Disposed in the two legs 14 of the capturing hook 9 are receiving bores 15, which are in alignment with one another and which, in the mounted position of the capturing hook 9, are coaxial relative to the transverse bore 12 in the bridge-like joining member 11. The horizontal transverse shaft 10 is inserted into the transverse bore 12 of the bridge-like joining member 11 and secured by means of a pin 16 to prevent it from falling out and twisting.

As FIG. 4 illustrates, the transverse shaft 10 has two bearing surfaces 17 with a reduced diameter on both of its ends. The transverse shaft 10 is mounted in the bridge-like joining member 11 in such a way that the two slimmer bearing surfaces 17 extend beyond the bridge-like joining member 11 on both ends. The capturing hook 9 is rotatably mounted on the two laterally protruding bearing surfaces 17 of the transverse shaft 10 by means of two bearing sleeves 18.

To mount the capturing hooks 9, the hooks are first positioned on the associated bridge-like joining member 11 of the support 2 in such a way that the receiving bores 15 are in alignment with the transverse bore 12. The transverse shaft 10 is then inserted into the transverse bore 12 in such a way that the ends of the two bearing surfaces 17 of the transverse shaft 10 evenly extend beyond both ends of the bridge-like joining member 11. The transverse shaft 10 is then secured in this position relative to the bridge-like joining member 11 by means of the pin 16. To this end, at a halfway point along the transverse shaft 10, the transverse shaft has a transverse bore 19, as seen in FIG. 4, for receiving the pin 16. Lastly, the two bearing sleeves 18 can be attached to the two bearing surfaces 17 of the transverse shaft 10 and be pushed into the receiving bores 15 in the legs 14 of the capturing hook 9.

Figure 5:
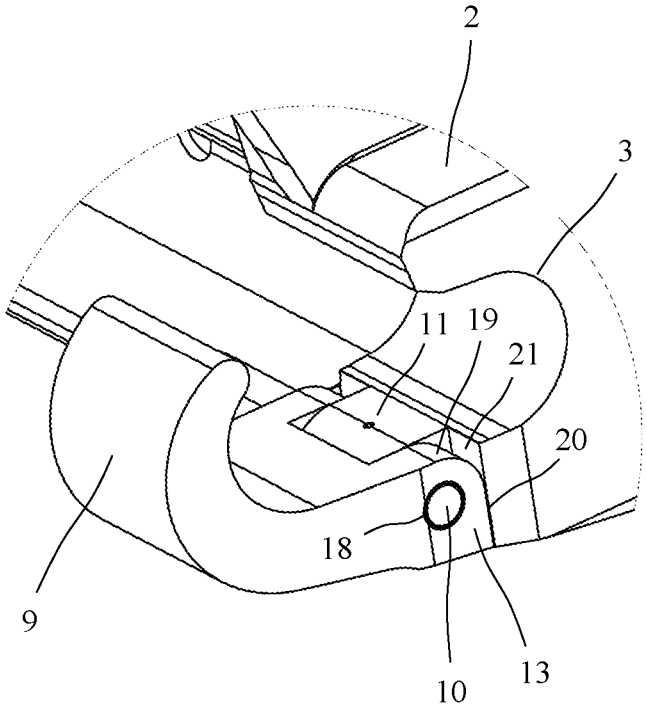
FIG. 5 an enlarged perspective view of a capturing hook in a lower starting position.
Figure 6:
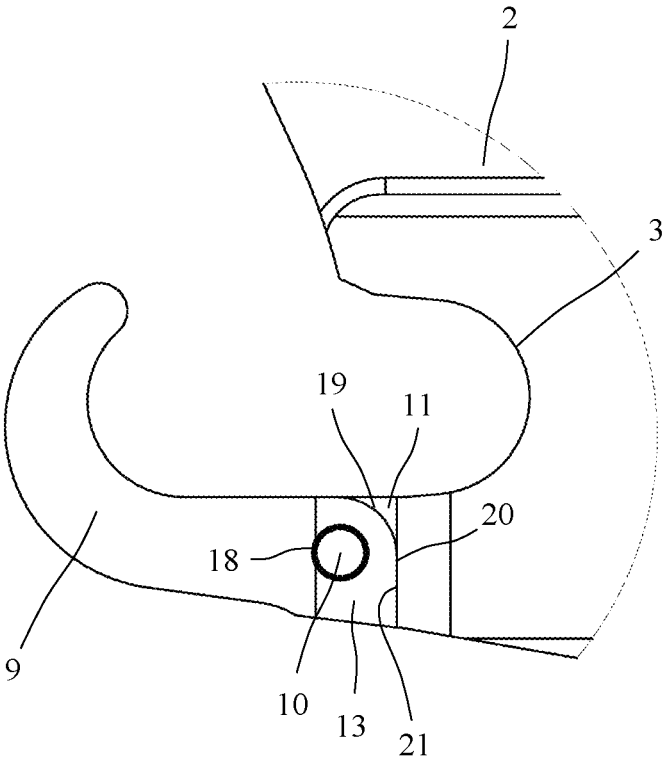
FIG. 6 an enlarged side view of a capturing hook in a lower starting position.
Figure 7:
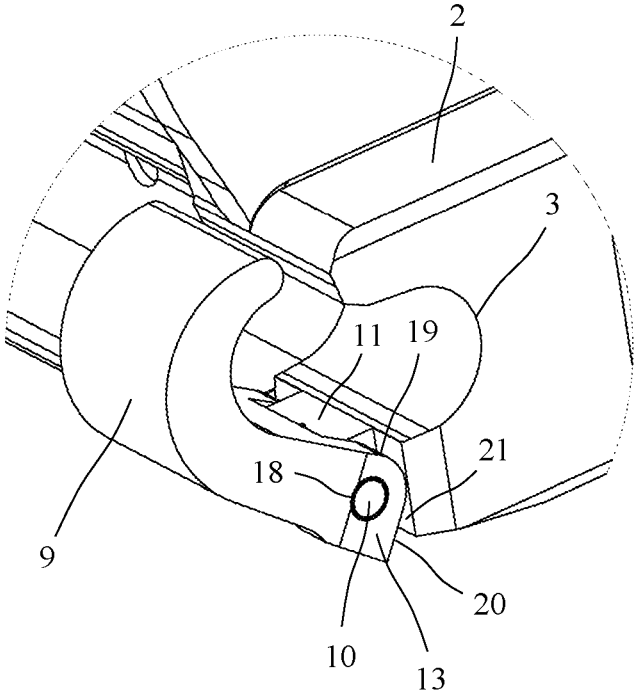
FIG. 7 an enlarged perspective view of a capturing hook in a folded position.
Figure 8:
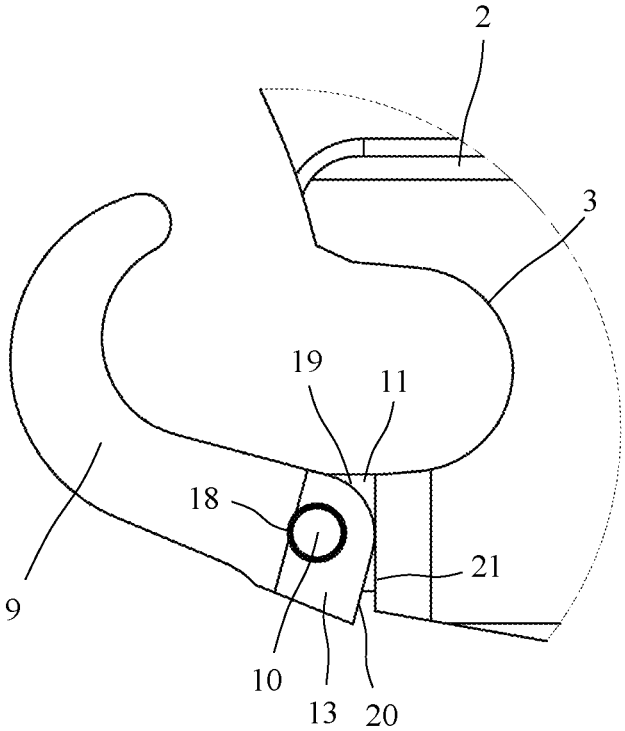
FIG. 8 an enlarged side view of a capturing hook in a folded position.

Owing to the pivotable and foldable arrangement, the capturing hooks 9 are able to move between a starting position as shown in FIGS. 5 and 6 and a folded position as shown in FIGS. 7 and 8. In the event that, e.g., an operator operating the quick-change device 1, causes the capturing hook 9 to bump into an obstacle or uses the capturing hooks 9 in an improper manner to support the excavator on the ground in order to turn it around or relocate it, the capturing hooks 9 can be folded in so that less strain is exerted on the connection to the support 2, thereby affecting the support to the lowest possible extent. Furthermore, in the event of damage to the capturing hook 9, the hook can be easily replaced if necessary.

As illustrated in FIGS. 5 to 8, the capturing hooks 9 have an upper curvature 19 on the rearward ends of the legs 14 facing in the direction of the support 2 and a rearward abutment surface 20 for abutting a front stop surface 21 of the support 2. In the lower starting position, the rearward abutment surfaces 20 of the capturing hook 9 abut the stop surface 21 of the support 2 so that the capturing hook 9 is held in place in this captured position. If considerable strain is exerted from below, the capturing hook 9, because of the curvature 19, can rotate about the transverse shaft 10 and move into an upper folded position. Both in the lower starting position and in the upper folded position, the receptacles 3 are closed toward the front by the capturing hooks 9 so that an attachment can be securely captured and held in place if the locking mechanism were to be unintentionally released. The capturing hooks 9 can be returned from the folded position into the starting position by gravity or by a return spring (not shown).

Figure 9:
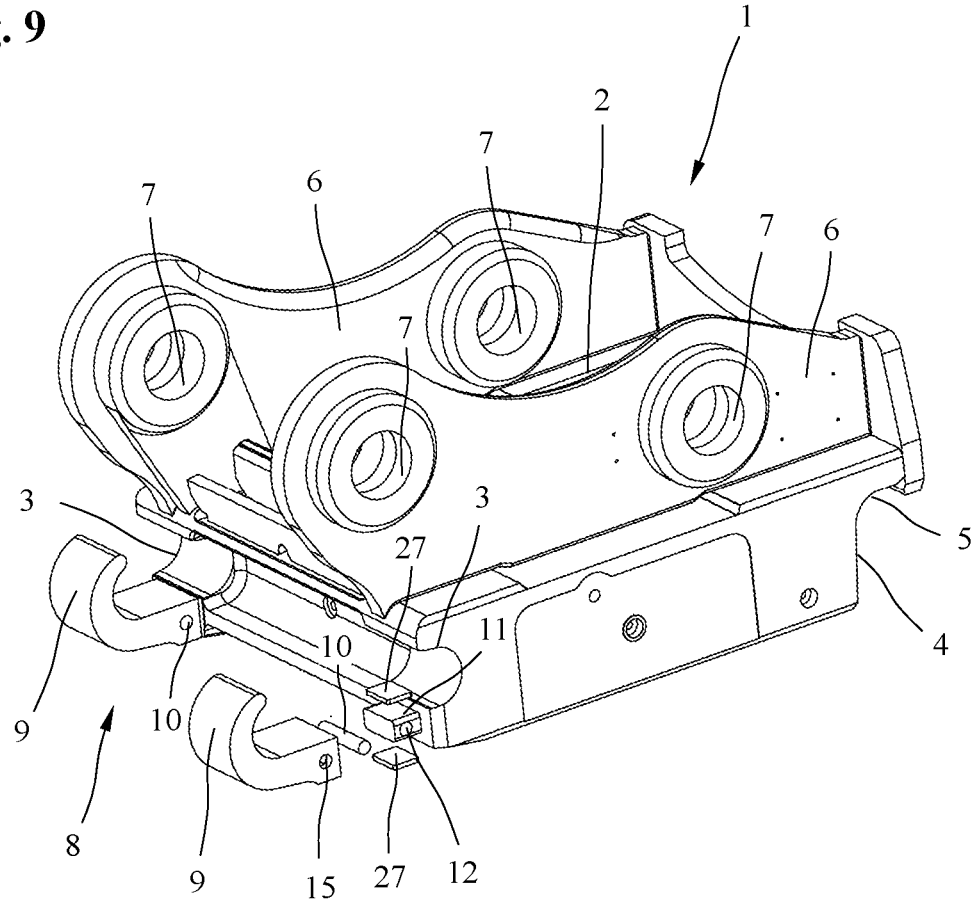
FIG. 9 a second embodiment of a quick-change device with a capturing hook arrangement seen in an exploded view.
Figure 10:
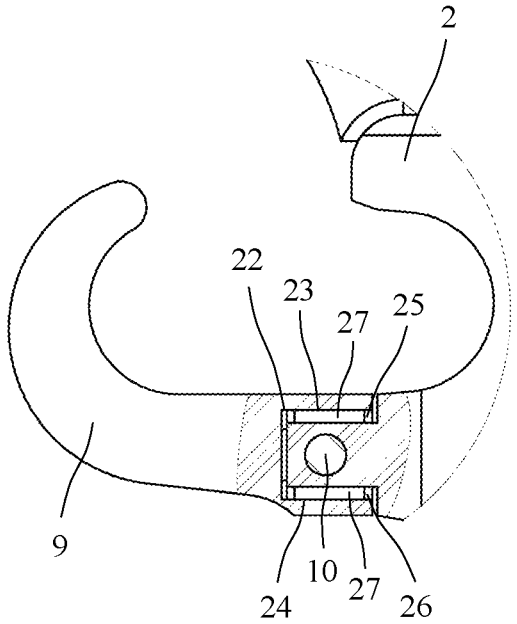
FIG. 10 an enlarged detail view of a capturing hook of the capturing hook arrangement of FIG. 9 in a non-pivoted starting position, and FIG. 11 an enlarged detail view of the capturing hook shown in FIG. 10 in a folded position.
Figure 11:
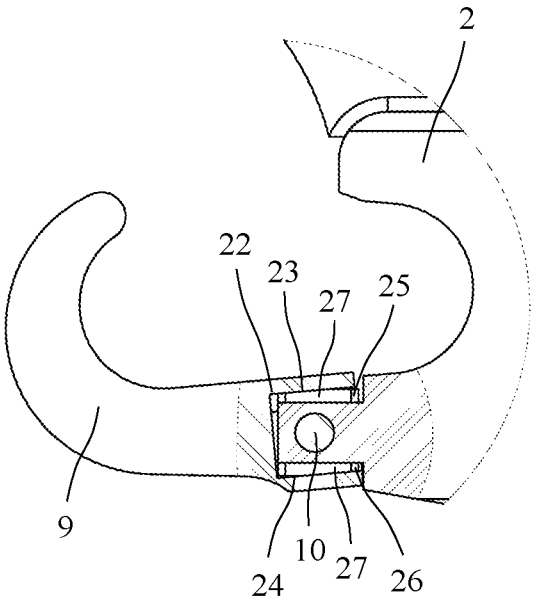

FIGS. 9 to 11 show a second embodiment according to the present invention of a quick-change device 1 having a capturing device 8. Again, in this embodiment, the capturing device 8 also has two separate capturing hooks 9 which are non-rigidly but pivotably disposed on the support 2 of the quick-change device 1. Again, the two capturing hooks 9 are hinged to bridge-like joining members 11 of the support 2 so as to be able to pivot about a transverse shaft 10. To this end, the bridge-like joining members 11 have a transverse bore 12, and the capturing hooks 9 have complementary receiving bores 15 for receiving the transverse shaft 10.

On the rearward side facing in the direction of the support 2, the capturing hooks 9 have a recess 22 with an upper and a lower inner surface 23 and 24, respectively, as seen in FIGS. 10 and 11. The recess 22 in the capturing hooks 9 is slightly larger than the bridge-like joining member 11, here configured in the shape of a block, so that between the bridge-like joining member 11 and the upper and lower inner surfaces 23 and 24, respectively, of the recess 22, an upper and a lower gap 25 and 26, respectively, are formed. A damping element 27 made of rubber or another elastic material is inserted each into the upper and the lower gap 25 and 26, respectively. Again, in this embodiment, the capturing hook 9 can also be pivoted relative to the support 2. However, in this embodiment, the pivoting and folding movement is limited by the size of the gap 25 and 26 and the yieldability of the damping element 27. In contrast to the first embodiment, however, the capturing hooks 9 are able to move not only upwardly but also downwardly without deformation of the capturing hook. Thus, the capturing hooks 9 are yieldably hinged to the support 2 so as to move both in the upward and in the downward direction.

FIGS. 12 to 15 show a third embodiment according to the present invention of a quick-change device 1 having a capturing device 8. Again, in this embodiment, the capturing device 8 also comprises two separate capturing hooks 9 which are non-rigidly, but pivotably disposed on the support 2 of the quick-change device 1. Again, in this embodiment, the two capturing hooks 9 are also hinged to bridge-like joining members 11 of the support 2 so as to be able to pivot about transverse shafts 10. In this embodiment, however, the transverse shafts 10 are not separate bolts or pins inserted into complementary transverse bores and receiving bores, but bearing journals integrally formed in one piece with the capturing hooks 9, by means of which the capturing hooks 9 are positioned in half-shell receptacles 28 on the bridge-like joining members 11 and held in place from below by a complementary part 29.

Figure 14:
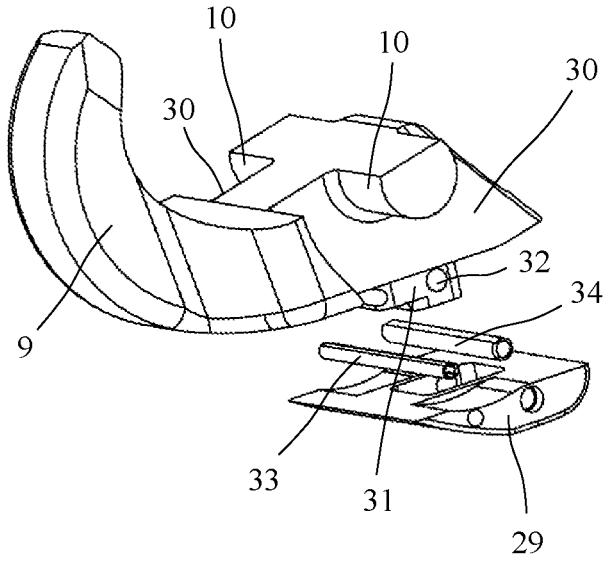
FIG. 14 an exploded view of a capturing hook shown in FIG. 13.

As illustrated in FIG. 14, the two laterally protruding transverse shafts 10 in the form of bearing journals are formed by lateral milled-off areas 30 on the capturing hooks 9. On its bottom face, the capturing hook has a bridge-like member 31 with transverse bores 32 for two heavy-duty spring pins 33 and 34, by means of which the complementary part 29 for holding the capturing hook 9 in place on the bridge-like joining member 11 is attached. The complementary part 29 prevents the capturing hook 9 from sliding upwards with its transverse shafts 10 out the bearing shell-shaped receptacles 28.

Figure 12:
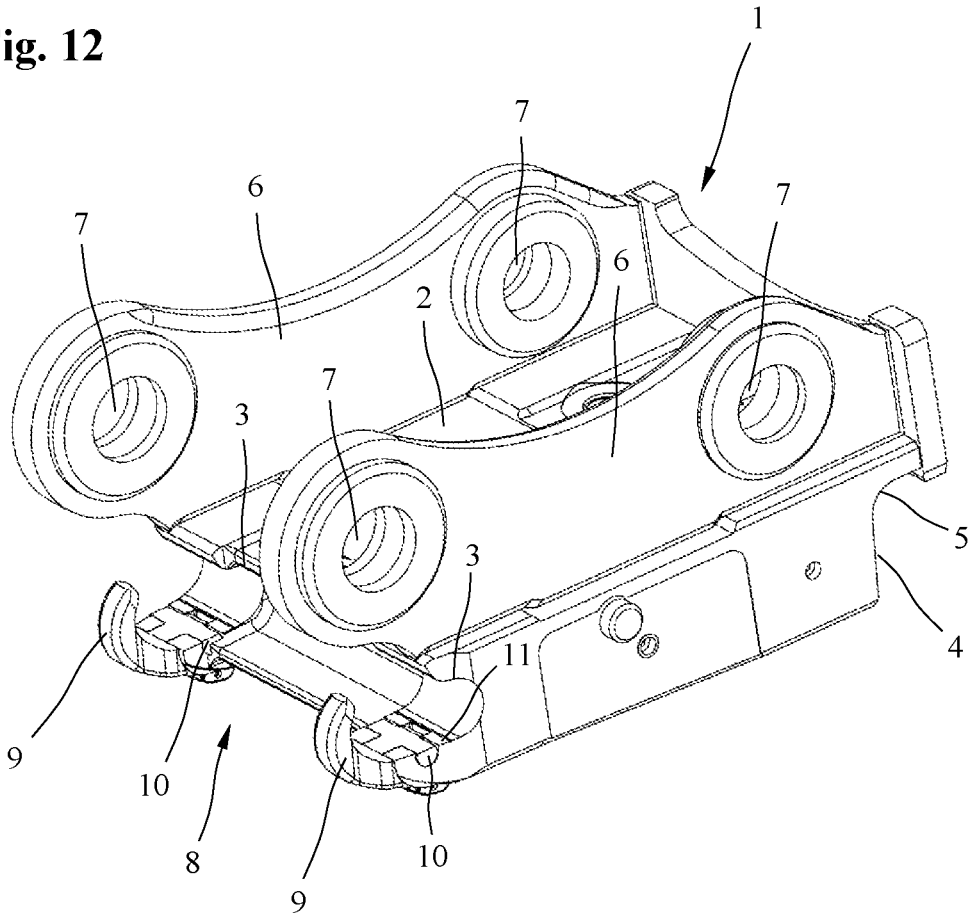
FIG. 12 a third embodiment of a quick-change device with a capturing hook arrangement.
Figure 13:
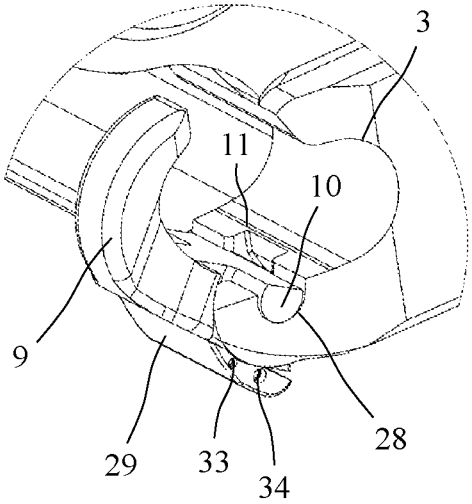
FIG. 13 a detail view of a capturing hook of the capturing hook arrangement of FIG. 12 in a folded position.
Figure 15:
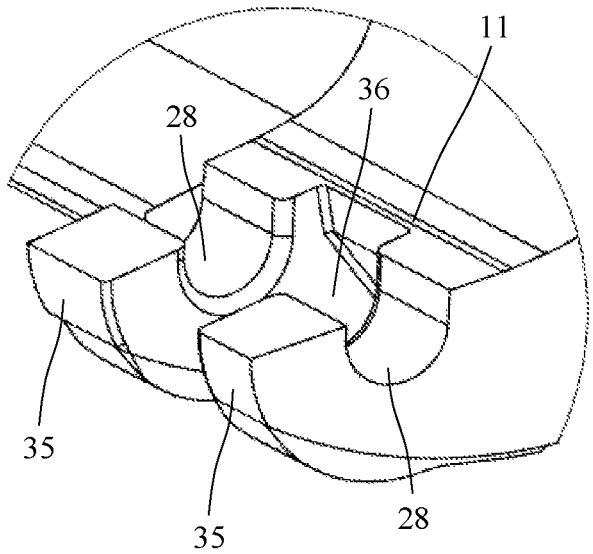
FIG. 15 a detail view of a receptacle for the capturing hook shown in FIG. 14.

It can be seen in FIG. 15 that in the bridge-like joining members 11 in the embodiment shown in FIG. 12 have two parallel legs 35 arranged at a distance from one another. The half-shell receptacles 28 for pivotably mounting the transverse shafts 10 are disposed on the top face of the two legs 35, which are separated from one another by an intermediate space 36. A capturing hook 9 protruding into the intermediate space 36 with its two laterally protruding transverse shafts 10 is inserted into the receptacles 28 and secured in place by the complementary part 29.

Again, in the embodiment shown in FIGS. 12 to 15, the capturing hook 9 can capture an attachment, which has been unintentionally released from its coupling position, in a captured position and thereby securely held in place on the quick-change device.

LIST OF REFERENCE CHARACTERS

1 Quick-change device
2 Support

3 First receptacle
4 Second receptacle
5 Abutment surface
6 Lateral part
7 Receiving opening
8 Capturing device
9 Capturing hook
10 Transverse shaft
11 Bridge-like joining member
12 Transverse bore
13 Intermediate space
14 Legs
15 Receiving bore
16 Pin
17 Bearing surface
18 Bearing sleeve
19 Curvature
20 Abutment surface
21 Stop surface
22 Recess
23 Upper inner surface
24 Lower inner surface
25 Upper gap
26 Lower gap
27 Damping element
28 Receptacle
29 Complementary part
30 Milled-of area
31 Bridge-like member
32 Transverse bore
33 Heavy-duty spring pin
34 Heavy-duty spring pin
35 Legs
36 Intermediate space
37 Locking element

What is claimed is:

1. A quick-change device for changing attachments on a construction machine, the device comprising a support, first receptacles arranged on one side of the support for receiving and retaining a first coupling element therein, second receptacles arranged on the other side of the support for receiving a second coupling element, a locking device for detachably holding the second coupling element in place and a capturing device arranged on the support for capturing the attachment, wherein the locking device has bolt-shaped locking elements which are moveable between a retracted released position and an extended locking position, wherein the capturing device has at least one capturing hook arranged on the support to capture and prevent the attachment from falling down as a result of an operator error or malfunctions caused by an unintentional movement of the locking elements into the released position, and wherein the at least one capturing hook is pivotably arranged on the support in a free manner to pivot upward into an upward folded position when an external force is applied to an outer surface of the at least one capturing hook, the pivoting upward movement of the at least one capturing hook substantially closing an opening toward the front of the first receptacles.

2. The quick-change device of claim 1, wherein the at least one capturing hook comprises two capturing hooks pivotably arranged on the first receptacles of the support.

3. The quick-change device of claim 1, wherein the at least one capturing hook is arranged on a joining member of the support so as to be pivotable about a transverse shaft.

4. The quick-change device of claim 3, wherein the joining member has a transverse bore and wherein the at least one capturing hook has receiving bores for receiving the transverse shaft.

5. The quick-change device of claim 3, wherein the at least one capturing hook is pivotably mounted on the transverse shaft by bearing sleeves.

6. The quick-change device of claim 3, wherein the transverse shaft is secured relative to the support by a pin to prevent the transverse shaft from falling out and twisting.

7. The quick-change device of claim 3, wherein the joining member protrudes into an intermediate space between two rearwardly protruding legs of the at least one capturing hook.

8. The quick-change device of claim 7, wherein the at least one capturing hook has an upper curvature on ends of the legs facing in a direction of the support and a rearward abutting surface for abutting a front stop surface of the support.

9. The quick-change device of claim 3, wherein the joining member protrudes into a recess on a rearward face of the at least one capturing hook, the recess having an upper inner surface and a lower inner surface.

10. The quick-change device of claim 9, wherein an upper and a lower gap are located between the joining member and the upper and the lower inner surfaces of the recess.

11. The quick-change device of claim 10, wherein a damping element is inserted into the upper and the lower gaps.

12. The quick-change device of claim 3, wherein the transverse shafts are bearing journals integrally formed in one piece with the capturing hooks, by which the capturing hooks are positioned in half-shell receptacles on the support and held in place from below by a complementary part.

13. The quick-change device of claim 12, wherein the half-shell receptacles for pivotably mounting the transverse shafts are arranged on the top face of two parallel legs spaced at a distance from one another on joining members of the support.

14. The quick-change device of claim 1, wherein the at least one capturing hook is designed to grasp around a coupling element engaging in the first receptacles.

* * * * *